US008607922B1

(12) United States Patent
Werner

(10) Patent No.: US 8,607,922 B1
(45) Date of Patent: Dec. 17, 2013

(54) HIGH FREQUENCY HORN HAVING A TUNED RESONANT CAVITY

(75) Inventor: Bernard M. Werner, Los Angeles, CA (US)

(73) Assignee: Harman International Industries, Inc., Northridge, CA (US)

( * ) Notice: Subject to any disclaimer, the term of this patent is extended or adjusted under 35 U.S.C. 154(b) by 0 days.

(21) Appl. No.: 13/230,786

(22) Filed: Sep. 12, 2011
(Under 37 CFR 1.47)

Related U.S. Application Data

(60) Provisional application No. 61/381,923, filed on Sep. 10, 2010.

(51) Int. Cl.
*G10K 11/02* (2006.01)

(52) U.S. Cl.
USPC ..... 181/182; 181/152

(58) Field of Classification Search
USPC ..... 181/152, 177, 182, 184; 381/340, 161
See application file for complete search history.

(56) References Cited

U.S. PATENT DOCUMENTS 1,449,530 A * 3/1923 Miller ..... 181/177
3,356,179 A * 12/1967 Tompkins ..... 181/152
4,893,695 A * 1/1990 Tamura et al. ..... 181/151
5,233,136 A * 8/1993 Hamada ..... 181/152
5,432,860 A * 7/1995 Kasajima et al. ..... 381/349
5,793,000 A * 8/1998 Sabato et al. ..... 181/152
5,932,850 A * 8/1999 Sabato et al. ..... 181/152
6,118,883 A * 9/2000 Rocha ..... 381/387

FOREIGN PATENT DOCUMENTS

JP 04369997 A * 12/1992
JP 05344577 A * 12/1993
JP 05344578 A * 12/1993

OTHER PUBLICATIONS

English translation of JP 05344578 A, accessed Jan. 18, 2013.*
English translation of JP 05344577 A, accessed Jun. 3, 2013.*

* cited by examiner

*Primary Examiner* — Jeremy Luks
(74) *Attorney, Agent, or Firm* — Brooks Kushman P.C.

(57) ABSTRACT

A high frequency horn for use in a multiple frequency loudspeaker system having a midrange transducer and a high frequency transducer is disclosed. The high frequency horn includes a horn chamber, horn mouth, a horn throat, a tuned resonant cavity, and a port connected to both the tuned resonant cavity and the horn chamber. The horn throat and horn chamber are located on opposite sides of the horn chamber, the port is located proximate to the horn throat, and the horn throat is configured to be connected to the high frequency transducer. The tuned resonant cavity is tuned to reduce high frequency standing waves produced by the midrange transducer within the horn chamber.

16 Claims, 14 Drawing Sheets

HIGH FREQUENCY HORN HAVING A TUNED RESONANT CAVITY

CROSS-REFERENCE TO RELATED APPLICATION

This application claims priority under 35 U.S.C. 119(e) to U.S. Provisional Patent Application Ser. No. 61/381,923, titled "HORN HAVING A RESONATE CHAMBER TO CORRECT MID-RANGE FREQUENCY RESPONSE," filed Sep. 10, 2010, which is herein incorporated by reference in its entirety.

BACKGROUND OF THE INVENTION

1. Field of the Invention

This invention relates generally to loudspeakers, and in particular to a system for controlling the frequency response of a horn loudspeaker.

2. Related Art

In general multi-way loudspeaker systems are well known. Typical examples of multi-way loudspeaker systems include two-way loudspeakers and three-way loudspeakers. Generally, multi-way loudspeaker systems include multiple transducers (generally referred to as "loudspeakers," "speakers," "sound drivers," or "drivers") that operate at different frequency ranges. As an example, typical two-way loudspeakers include a low-frequency transducer and a high-frequency transducer, while typical three-way loudspeakers include a low-frequency transducer, a mid-frequency transducer (generally known as "midrange transducer" and "midrange driver"), and a high-frequency transducer.

In FIG. 1, a perspective view of an example of an implementation of a known three-way loudspeaker 100 is shown. In this example, the three-way loudspeaker 100 may include a housing 102, one or more low-frequency transducers (not shown) behind some sound baffles 104, one or more mid-frequency transducers (not shown) located behind one of more sound integrators (such as for example a "radiation boundary integrator" ("RBI")) 106 to control sound, and one of more high-frequency transducers (not shown) connected to one or more sound waveguides (also known as high-frequency horns) 108. This example is more fully described by U.S. Pat. No. 7,324,654, titled "Arbitrary Coverage Angle Sound Integrator," filed on Jul. 1, 2003 and U.S. Pat. No. 7,134,523, titled "System For Integrating Mid-Range and High-Frequency Acoustic Sources In Multi-way Loudspeakers," filed on Nov. 22, 2002, both of which are herein incorporated by reference in their entirety. This example is also implemented in a product known as JBL® VerTec VT4889 produced by Harman International Industries, Inc. of Stamford, Conn.

Turning to FIG. 2, a exploded side-view of an example of an implementation of a high-frequency transducer 200 and two mid-frequency (also known as "mid-range") transducers 202 and 204 within the three-way loudspeaker 100 of FIG. 1 is shown. The high-frequency transducer 200 is connected to a high-frequency horn 206, which is a sound waveguide, via the horn driver side 208. The high-frequency transducer 200 is also known as a high-frequency driver. The high-frequency horn 206 and mid-frequency transducers 202 and 204 are connected to sound integrators 210 and 212, respectively. The high-frequency horn 206 is connected to the sound integrators 210 and 212 at an open end 214 of the high-frequency horn 206 that is opposite the horn driver side 208. In this example, the sound integrators 210 and 212 may act as flares of the high-frequency horn 206 and are described in U.S. Pat. Nos. 7,134,523 and 7,324,654. The sound integrators 210 and 212 includes mating members (not shown) for engagement with the mid-frequency transducers 202 and 204, respectively. The high-frequency horn 206 is a horn loudspeaker element that uses a horn to increase the overall efficiency of the high-frequency transducer 200 (also known as "driving element").

The high-frequency horn 206 is a passive component and does not amply the sound from the high-frequency transducer 200 but rather improves the coupling efficiency between the high-frequency horn 206 on the horn driver side 208 and the air on the open end 214. The high-frequency horn 206 may be thought of as an "acoustic transformer" that provides impedance matching between the relatively dense diaphragm material(s) (not shown) of the high-frequency transducer 200 at the horn driver side 208 to the air of low density at the open end 214. The result is greater acoustic output from the high-frequency transducer 200. The high-frequency horn 206 is generally a hollow tube, or pipe, defining an empty chamber (also known as a "cavity") (not shown) volume between the horn driver side 208 and open end 214. The high-frequency horn 206 includes a surface wall 216 that defines the empty chamber of the high-frequency horn 206 and tappers from a narrow part of the high-frequency horn 206 at the horn driver side 208 to large part of the high-frequency horn 206 at the open end 214. The tapering part of the surface wall 216 is typically known as "flare" of the horn. Generally, the narrow part of the narrow part of the high-frequency horn 206 at the horn driver side 208 is known as the "throat" of the high-frequency horn 206 and the large part of the high-frequency horn 206 at the open end 214 is known as the "mouth" of the high-frequency horn 206.

In FIG. 3, a top assembly-view of an example of an implementation of a high-frequency transducer 200, high-frequency horn 206, and sound integrators 210 and 212 is shown. The sound integrators 210 and 212 include mounting mechanisms 300 and 302, respectively, positioned on the rear of the sound integrators 210 and 212 to permit the mounting of mid-frequency transducers (not shown).

Turning to FIG. 4, a cross-section view of an example of an implementation of two high-frequency horns 400, 402, and a sound integrator 404 is shown. The throats of the two high-frequency horns 400, 402 includes mating members 406 and 408, respectively, for engagement with a high-frequency transducer (such as for example, high-frequency transducer 200) and, at the opposing end (i.e., the mouth of the high-frequency horns 400 and 402), opens to sound integrator 210 which may act as a continuation of the horn flare of the high-frequency horns 400 and 402. Optionally, vanes (not shown) may be included within the empty chambers 410 and 412, respectively, of the high-frequency horns 400 and 402 (i.e., between the mouth and throats of the high-frequency horns).

In an example of operation, the high-frequency transducer 200 injects the high-frequency horn 206 with high-frequency sound waves 218 that travels through the high-frequency horn 206 and is output from the open end 214 of the high-frequency horn 206. The high-frequency horn 206 converts large pressure variations with a small displacement area at the horn driver side 208 into a low pressure variation with a large displacement area at the open end 214, and vice versa. The high-frequency horn 206 does this through the gradual, often exponential increase of the cross sectional area of the high-frequency horn 206 from the horn driver side 208 to the open end 214. The small cross-sectional area of the throat at the horn driver side 208 restricts the passage of air thus presenting a high impedance to the high-frequency transducer 200. This allows the high-frequency transducer 200 to develop a high pressure for a given displacement. Therefore the high-frequency sound waves 218 at the throat are of high pressure and low displacement. The tapered shape of the high-frequency horn 206 allows the high-frequency sound waves 218 to gradually decompress and increase in displacement until they reach the mouth at the open end 214 where they are of a low pressure but large displacement.

Simultaneously, the mid-frequency sources 202 and 204 inject sound integrators 210 and 212, respectively, with mid-frequency sound waves 220 and 222, respectively, that pass through the sound integrators 210 and 212. The combination of the high-frequency sound waves 218 and mid-frequency sound waves 220 and 222 produce combined output sound wave(s) 224 in the far-field of three-way loudspeaker 100. The combined output sound wave 224 may also include the low-frequency sound waves (not shown) produced by the low-frequency transducers (not shown) described in FIG. 1.

Unfortunately, in this example, a portion of the mid-frequency sound waves 220 and 222 is transmitted into the open end 214 of the high-frequency horn 206. As such, leaked sound waves 224 and 226 enter the high-frequency horn 206. The high-frequency horn 206 acts as a closed pipe to the leaked sound waves 224 and 226 and the midrange acoustical energy from the leaked sound waves 224 and 226 form standing waves in the high-frequency horn 206 at various frequencies. Unfortunately, the formation of these acoustical standing waves result in "dips" in the far-field midrange frequency response of the combined output sound waves 224 due to acoustical cancelation at the frequencies where the "dips" occur. A need therefore exists for a multi-way loudspeaker design that corrects the resulting dips in the far-field midrange frequency response caused by the standing waves in the high-frequency horn 206.

SUMMARY

To address the above illustrated problems, a high frequency horn design is provided that corrects the "dips" in the far-field midrange frequency response by adding a tuned resonant cavity in the horn chamber of the high frequency horn, physically close to the horn throat. The tuning frequency of the tuned resonant cavity is adjusted to cancel the undesirable standing wave behavior produced by the midrange transducer. Acoustically absorptive material may be added inside the tuned resonant cavity to further adjust the tuning frequency.

A high frequency horn for use in a multiple frequency loudspeaker system having a midrange transducer and a high frequency transducer is disclosed. The high frequency horn includes a horn chamber, horn mouth, a horn throat, a tuned resonant cavity, and a port connected to both the tuned resonant cavity and the horn chamber. The horn throat and horn mouth are located on opposite sides of the horn chamber, the port is located proximate to the horn throat, and the horn throat is configured to be connected to the high frequency transducer. The tuned resonant cavity is tuned to reduce high frequency standing waves produced by the midrange transducer within the horn chamber.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 5:
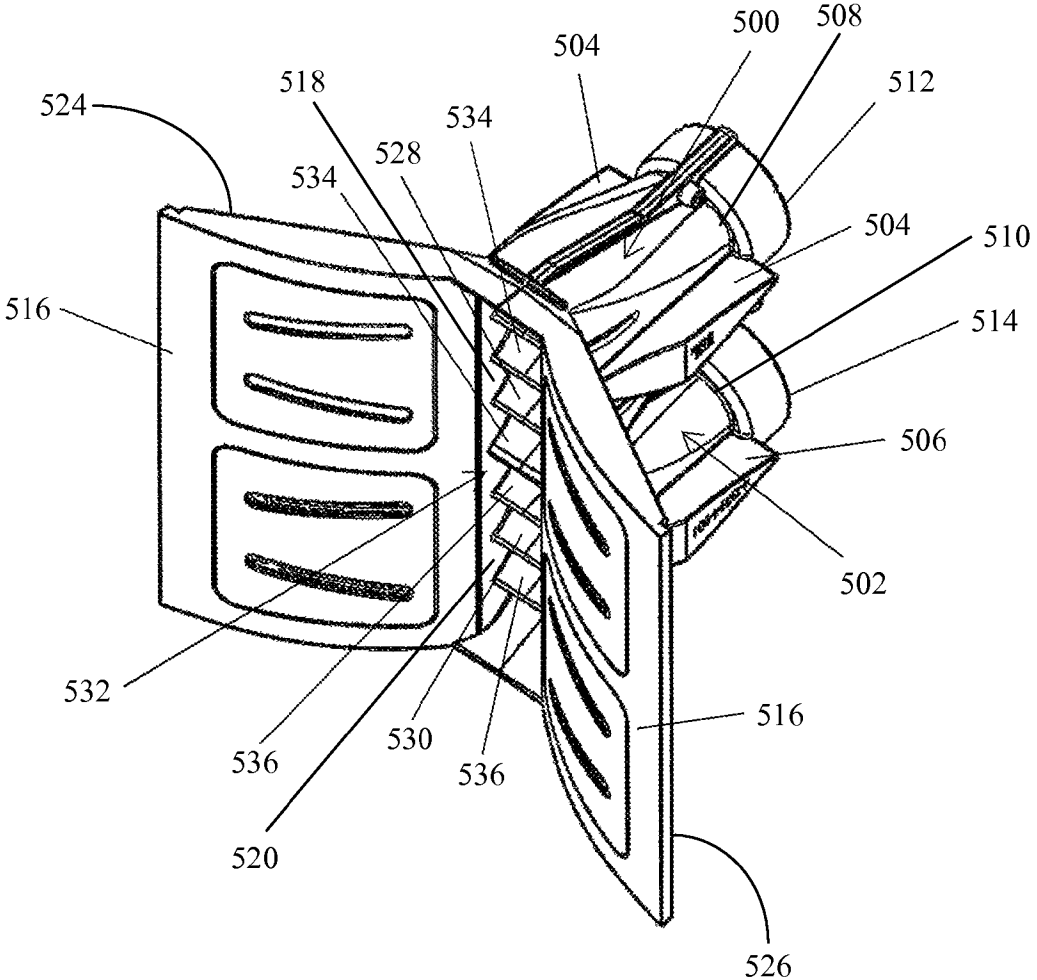
FIG. 5 shows a perspective view of an example of an implementation of two high frequency horns each utilizing a tuned resonate cavity in accordance with the present invention.

FIGS. 5 through 13 illustrate various implementations of a high frequency horn 500 of the invention. In FIG. 5, a perspective view of an example of an implementation of two high frequency horns 500 and 502 each utilizing a tuned resonate cavity 504 and 506, respectively, (also referred to interchangeably as "tuned resonate chambers 504 and 506") is shown. The high frequency horns 500 and 502 utilize a horn design that includes a horn throat 508 and 510 each connected to the high frequency transducer 512 and 514 (also referred to interchangeably as "high frequency drivers 508 and 510"), on one end, and a horn mouth 518 and 520 connected to opposing horn flares 516 at the opposite end of the high frequency horn 500 and 502, respectively, where the horn flares 516 may be sound integrators (which are described in U.S. Pat. Nos. 7,134,523 and 7,324,654). The hollow taper tube sections in the high frequency horn 500 and 502 are known as horn chambers which extend between each horn throat 508 and 510 and each horn mouth 518 and 520. As illustrated in the FIG. 5, each high frequency horn 500 and 502 utilizes a tuned resonant cavity 504 and 506 positioned at the throat of the high frequency horn 500 and 502 near the high frequency transducers 512 and 514, respectively.

The combination of high frequency horns 500 and 502 represented in FIG. 5 is an example of a line array loudspeaker comprised of one or more high frequency drivers (i.e., high frequency transducers 512 and 514) each attached to the respective throat 508 and 510 of high frequency horns 500 and 502. The mouths 518 and 520 of the high frequency horns 500 and 502, respectively, open to the horn flare 516, which includes mounting mechanisms (not shown) for permitting midrange transducers (i.e., mid-frequency transducers, which are not shown) to be mounted to the back sides 524 and 526 of the horn flare 516.

It is appreciated by those skilled in the art that the phrase "connected" in this application includes the meaning that parts are physically in contact, coupled, linked, joined, connected though one or more intermediate parts that are physically in contact or other similar meanings.

Figure 1:
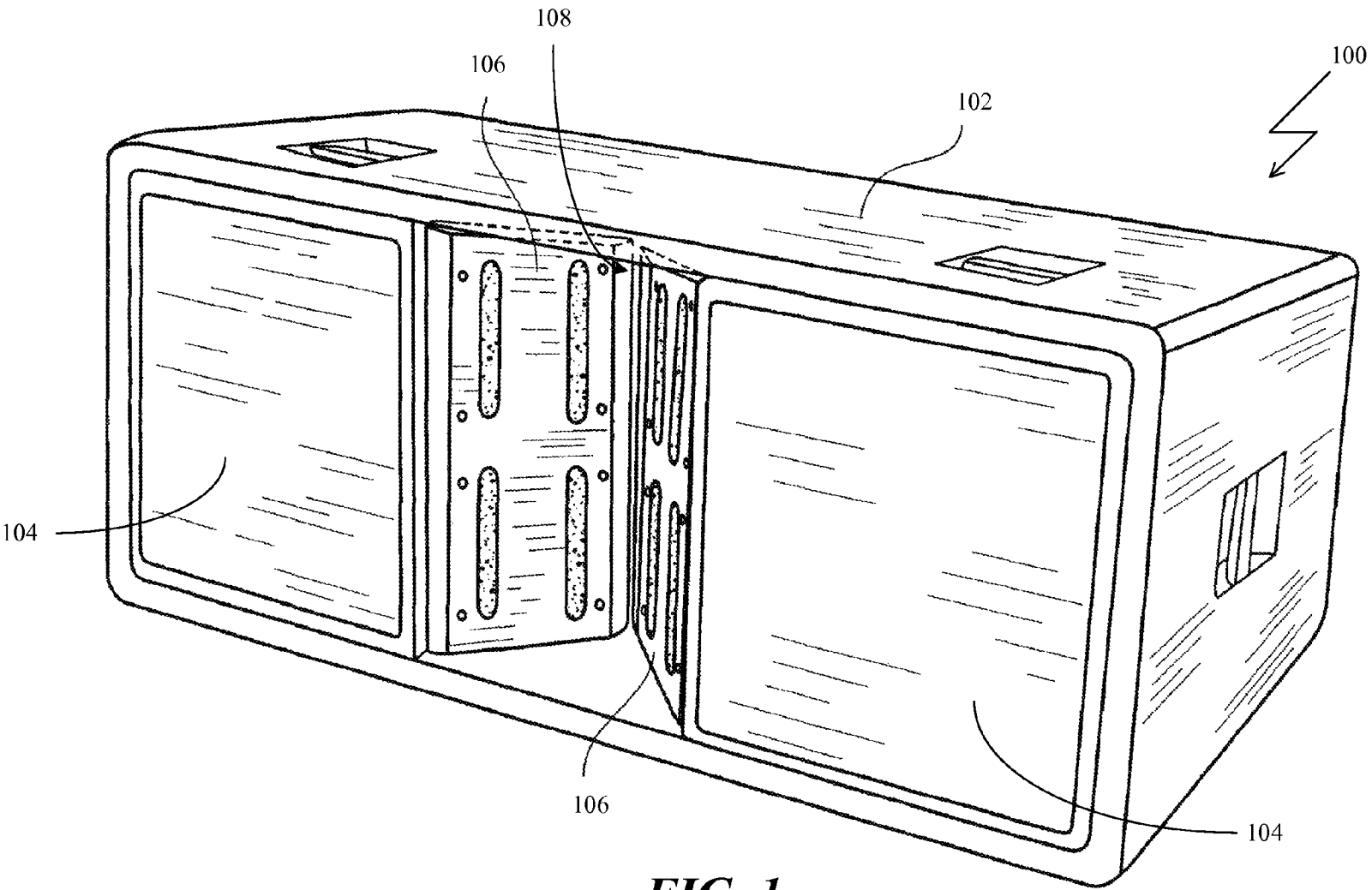
FIG. 1 (Prior Art)
FIG. 1 shows a perspective view of an example of an implementation of a known three-way loudspeaker.
Figure 4:
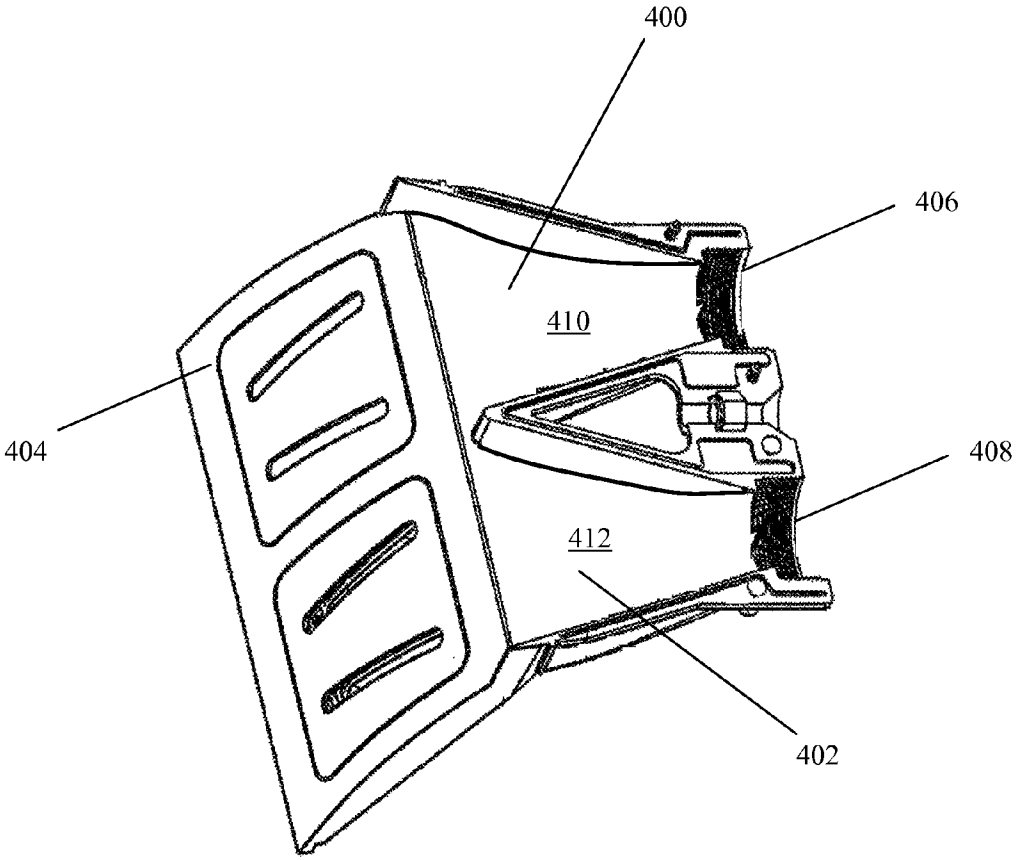
FIG. 4 (Prior Art)
FIG. 4 shows a cross-section view of an example of an implementation of two high-frequency horns and a sound integrator.

Unlike the prior art high frequency horns shown in FIGS. 1 and 4, the high frequency horns 500 and 502 illustrated in FIG. 5 include tuned resonant cavities 504 and 506 extending from the sides of the throats 508 and 510 of the high frequency horns 500 and 502. These tuned resonant cavities 504 and 506 are positioned near the high frequency drivers 512 and 514 to cancel the midrange acoustical energy from the midrange transducers, which acoustical energy forms standing waves in the high frequency horns 500 and 502. These tuned resonant cavities 504 and 506 utilize the general principles behind that of a Helmholtz resonator to provide a resonant frequency to cancel the standing waves in the high frequency horns 500 and 502.

In general, a Helmholtz resonator is a closed volume of air communicating with the outside through a port. An example of Helmholtz resonance is the sound created when one blows across the top of an empty bottle. The enclosed air resonates at a specific frequency that depends on the volume of the cavity contained in the vessel as well as the dimensions of the port opening (also referred to a neck) being utilized. In general, larger chamber volumes produce lower resonate frequencies and smaller chamber volumes produce higher resonate frequencies.

It is appreciated by those skilled in the art that Helmholtz resonators used for loudspeaker enclosures are typically in the form of a rectangular box with a pipe located in a circular opening whose diameter is typically smaller than that of the loudspeaker. Helmholtz resonators can be thought of as analogous to an object with a certain mass connected to a spring. The air enclosed in the cavity (acting as a kind of cushion) provides the stiffness of the system, thus acting as a spring, and the air enclosed in the pipe acts as a mass. Together, this produces a resonator of a specific frequency.

Changes in the dimensions of the cavity adjust the properties of the spring: a larger cavity would make for a weaker spring, and vice-versa. Similarly, a longer port would make for a larger mass, and vice-versa. The diameter of the port is related to the mass of air and the volume of the cavity. Thus, a port that is too small in area for the cavity volume will "choke" the flow while one that is too large in area for the cavity volume tends to reduce the momentum of the air in the port.

Applying this principle to the present invention, the equation for that of a Helmholtz resonator that governs the tuning of the tuned resonant cavities 504 and 506 is derived by first showing that the resonant angular frequency is given by:

$$\omega_H = \sqrt{\gamma \frac{A^2}{m} \frac{P_0}{V_0}} \ (\underline{\text{rad}}/s),$$

where:

γ (gamma) is the adiabatic index or ratio of specific heats (this value is usually 1.4 for air and diatomic gases).

A is the cross-sectional area of the neck m is the mass in the neck $P_0$ is the static pressure in the cavity $V_0$ is the static volume of the cavity For cylindrical or rectangular necks:

$$A = \frac{V_n}{L},$$

where L is the length of the neck and $V_n$ is the volume of air in the neck.

Thus, $$\omega_H = \sqrt{\gamma \frac{A}{m} \frac{V_n}{L} \frac{P_0}{V_0}}$$

By the definition of density:

$$\frac{V_n}{m} = \frac{1}{\rho},$$

thus:

$$\omega_H = \sqrt{\gamma \frac{P_0}{\rho} \frac{A}{V_0 L}},$$

and $$f_H = \frac{\omega_H}{2\pi},$$

where $f_H$ is the resonant frequency.

As the speed of sound in a gas is given by:

$$v = \sqrt{\gamma \frac{P_0}{\rho}},$$

thus, the frequency of the resonance is:

$$f_H = \frac{v}{2\pi} \sqrt{\frac{A}{V_0 L}}$$

Utilizing the frequency resonance from a Helmholtz resonator, one or more tuned resonant cavities 504 and 506 can be provided in the high frequency horns 500 and 502 at locations sufficiently adjacent and proximate to the high frequency transducers 512 and 514, respectively, (i.e., he throats 508 and 510) to cancel the midrange acoustical energy forming in the high frequency horns 500 and 502. In the example, the tuned resonant cavities 504 and 506 are formed in a central vane 528 and 530 with the respective high frequency horn 500 and 502. As will be further illustrated in connection with FIG. 8, acoustically absorptive material (not shown) may also be added inside the tuned resonant cavities 504 and 506 to further tune the resonant frequency of the cavities as necessary to cancel the standing wave behavior in the high frequency horns 500 and 502.

Turning back to FIG. 5 and as described earlier, each high frequency horn 500 and 502 is connected to a high frequency transducer 512 and 514, respectively, where each high frequency horn 500 and 502 terminates at a horn mouth 518 and 520, respectively. In this example, both horn mouths 518 and 520 combine to form a combined horn opening 532 that is connected to the horn flare 516, which permits the mounting of midrange drivers on the back sides of the horn flare 526. As can be seen from the combined horn opening 532, side vanes 534 and 536 may be positioned adjacent to the central vanes 528 and 530 within the high frequency horns 500 and 502, respectively. Also shown on the sides of the high frequency horns 500 and 502 are the tuned resonant cavities 504 and 506.

Figure 2:
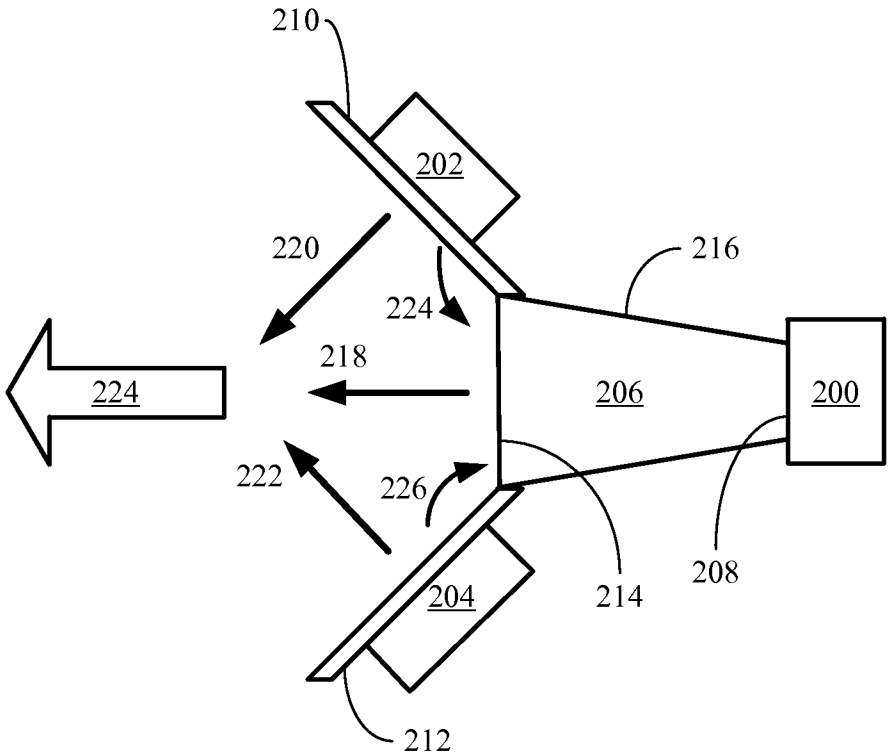
FIG. 2 (Prior Art)
FIG. 2 shows an exploded side-view of an example of an implementation of a high-frequency transducer and two mid-frequency transducers within the three-way loudspeaker of FIG. 1.
Figure 3:
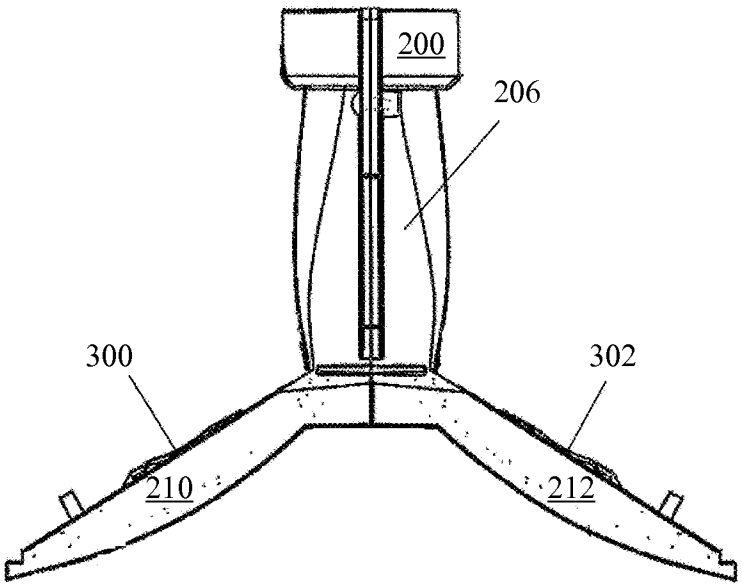
FIG. 3 (Prior Art)
FIG. 3 shows a top assembly-view of an example of an implementation of a high-frequency transducer, high-frequency horn, and sound integrators.
Figure 6:
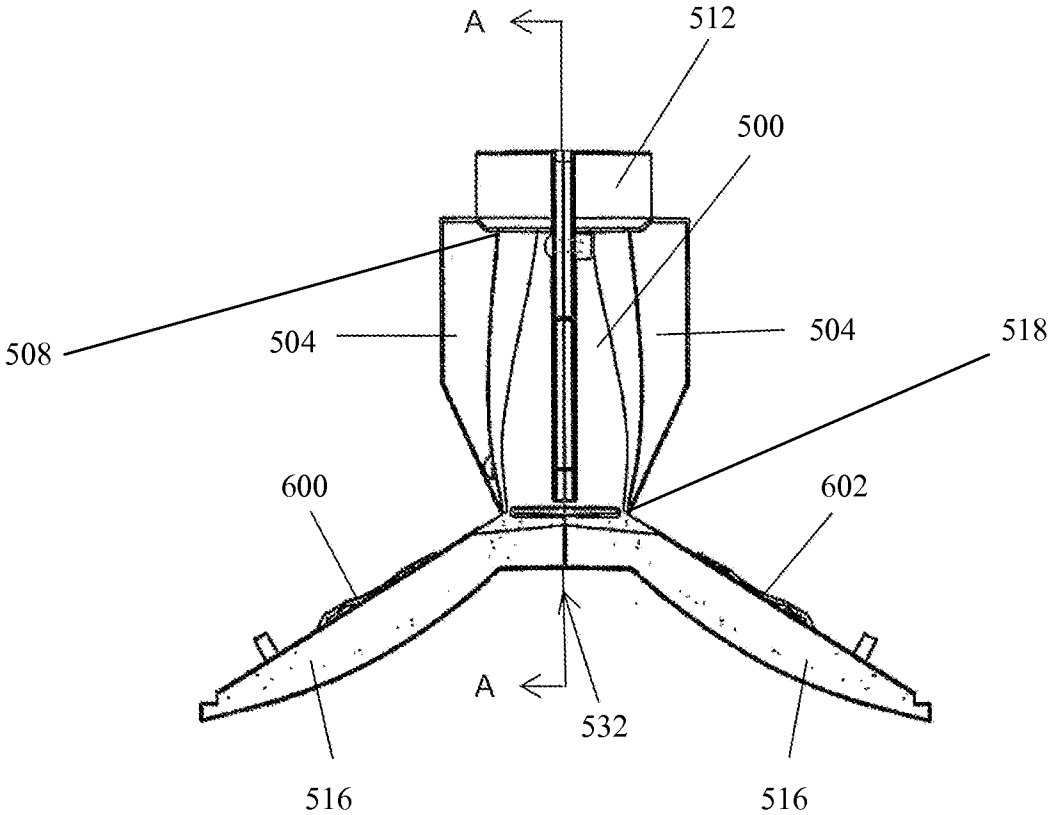
FIG. 6 shows a top view of the high frequency horn connected to the horn flare in accordance with the present invention.

In FIG. 6, a top view of the high frequency horn 500 connected to the horn flare 516 is shown. Similar to FIG. 5, the high frequency horn 500 includes a horn throat 508, which is connected to the high frequency transducer 512, and a horn mouth 518, which is connected to the horn flares 516, opposite the horn throat 508. The horn flares 516 are configured, through the mounting mechanisms 600 and 602, to mount two mid-range frequency transducers (not shown) to the side walls of the horn flares 516. Unlike the prior art horn 206 in FIGS. 2 through 4, the high frequency horn 500 includes a tuned resonant cavity 504 extending from the sidewalls 604 of the horn throat 508.

Figure 7:
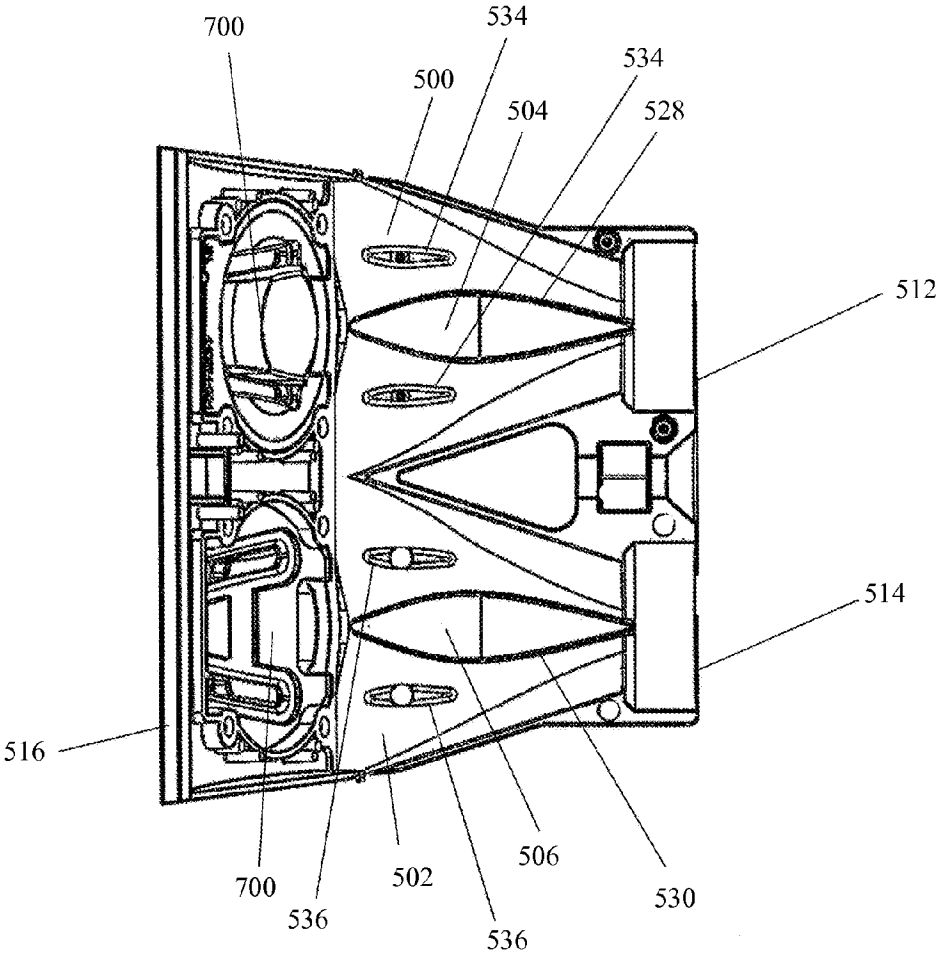
FIG. 7 shows a side elevation view of the high frequency horns of FIG. 5.

Turning to FIG. 7, a side elevation view of the high frequency horns 500 and 502 is shown. Similar to FIG. 6, FIG. 7 also shows the tuned resonant cavities 504 and 506 extending from the sidewalls of the high frequency horns 500 and 502, respectively. Also shown in FIG. 7 are the mounting mechanisms 700 permitting the attachment of the midrange transducers to the sidewalls of the horn flare 516.

Figure 8:
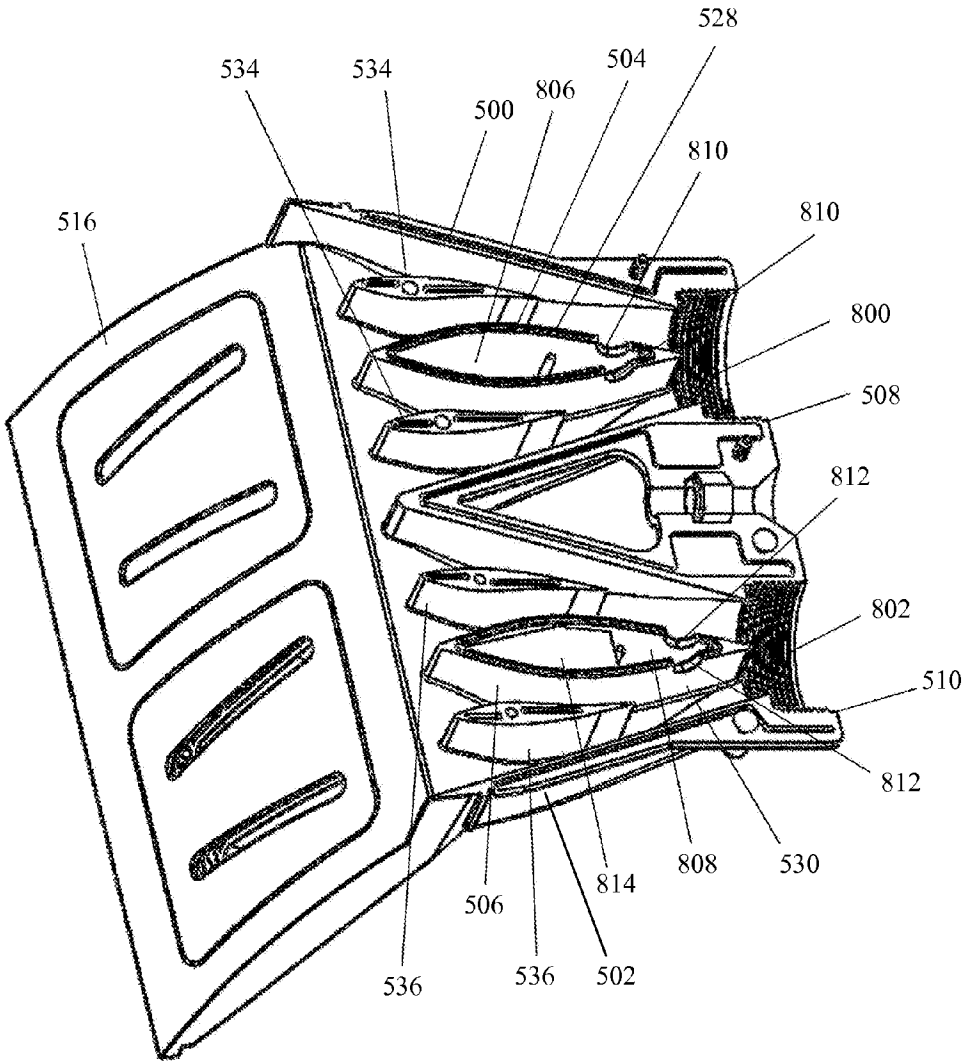
FIG. 8 shows a cross section view of the high frequency horns taken along section line A-A of FIG. 6.

FIG. 8 shows a cross section view of the high frequency horns 500 and 502 taken along section line A-A of FIG. 6. In this view, the high frequency transducers 512 and 514 are not present. Rather, mating members 800 and 802 are shown at the entrance of the horn throats 508 and 510, respectively, for securing the high frequency transducers 512 and 514 to the horn throats 508 and 510. In this example, side vanes 534, 536 and central vanes 528, 530 are positioned in the high frequency horns 500 and 502, respectively. The tuned resonant cavities 504 and 506 are then defined by cavities 806 and 808 in the central vanes 528 and 530 of the high frequency horns 500 and 502, respectively. Ports or openings 810 and 812 are provided in the central vanes 528 and 530, respectively, to create the neck of the tuned resonant cavities 504 and 506. Optionally, acoustic dampening material 814 may be included within the cavity 808 in the central vane 506 to further tune the resonant chamber. Similarly, acoustic dampening material (not shown) may also be included within the cavity 806 in the central vane 528 to still further tune the resonant chamber.

The cross-section view in FIG. 8 shows the high frequency horns 500 and 502 split in half about the vertical center-line. The location of the tuned resonant cavities 504 and 506 formed within the central vanes 528 and 530, as well as the port 810 and 812 formed in the central vanes 528 and 530 are shown. Further, two alternative implementations for creating the tuned resonant cavities 504 and 506 are shown. The upper cavity 806 in the upper central vane 528 illustrates a tuned resonant cavity 504 without acoustically absorptive material in the cavity 806, while the lower cavity 808 in the lower central vane 530 shows a tuned resonant cavity 506 with acoustical damping material 814 in the tuned resonant cavity 804.

Figure 9:
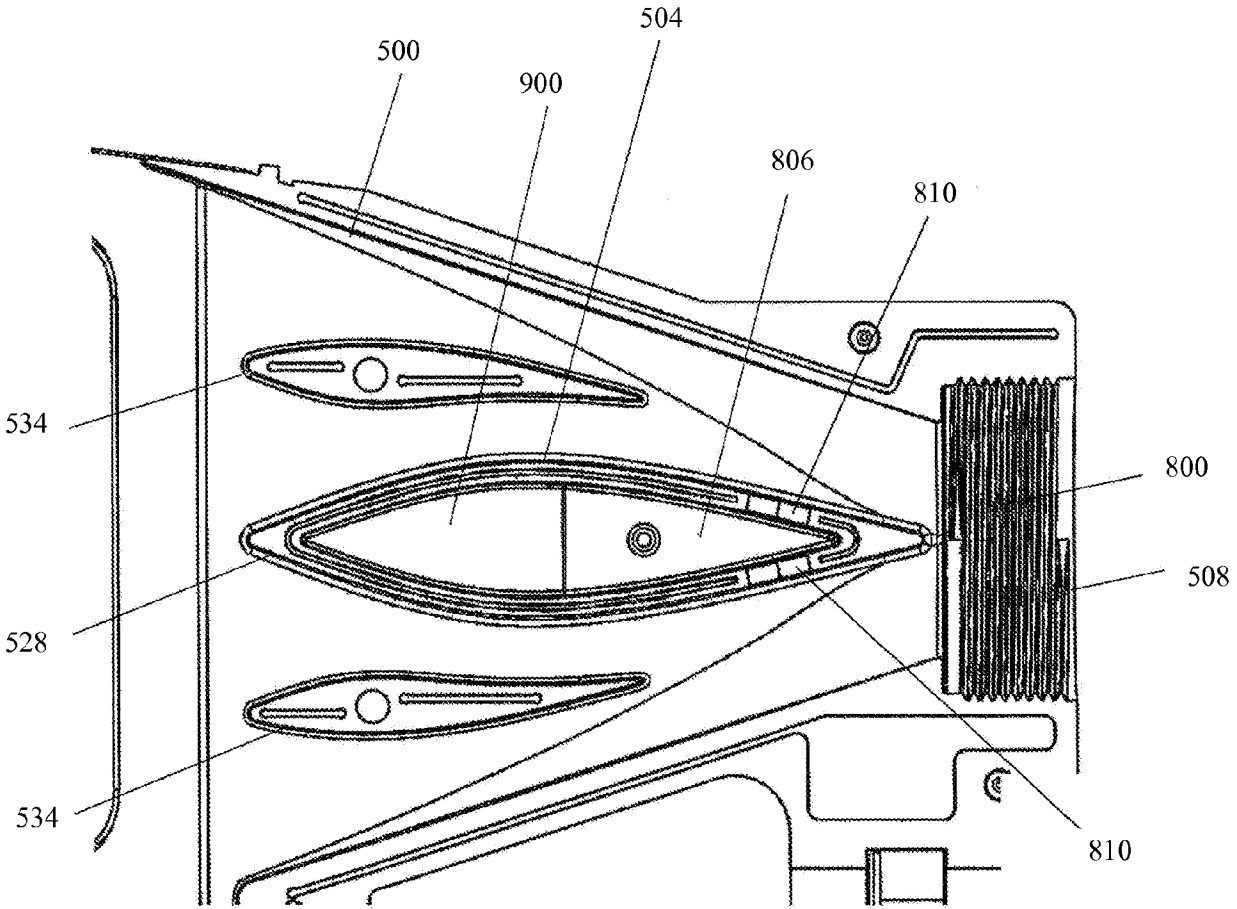
FIG. 9 shows an enlarged view of the tuned resonant cavity formed in the lower central vane shown in FIG. 8.

FIG. 9 shows an enlarged view of the tuned resonant cavity 522 formed in the lower central vane 528. As illustrated in FIG. 9, the central vane 528 shows the opening, or port, 810 of the tuned resonant cavity 504 and includes dampening material 900 in the cavity 806 of the tuned resonant cavity 504.

Figure 10:
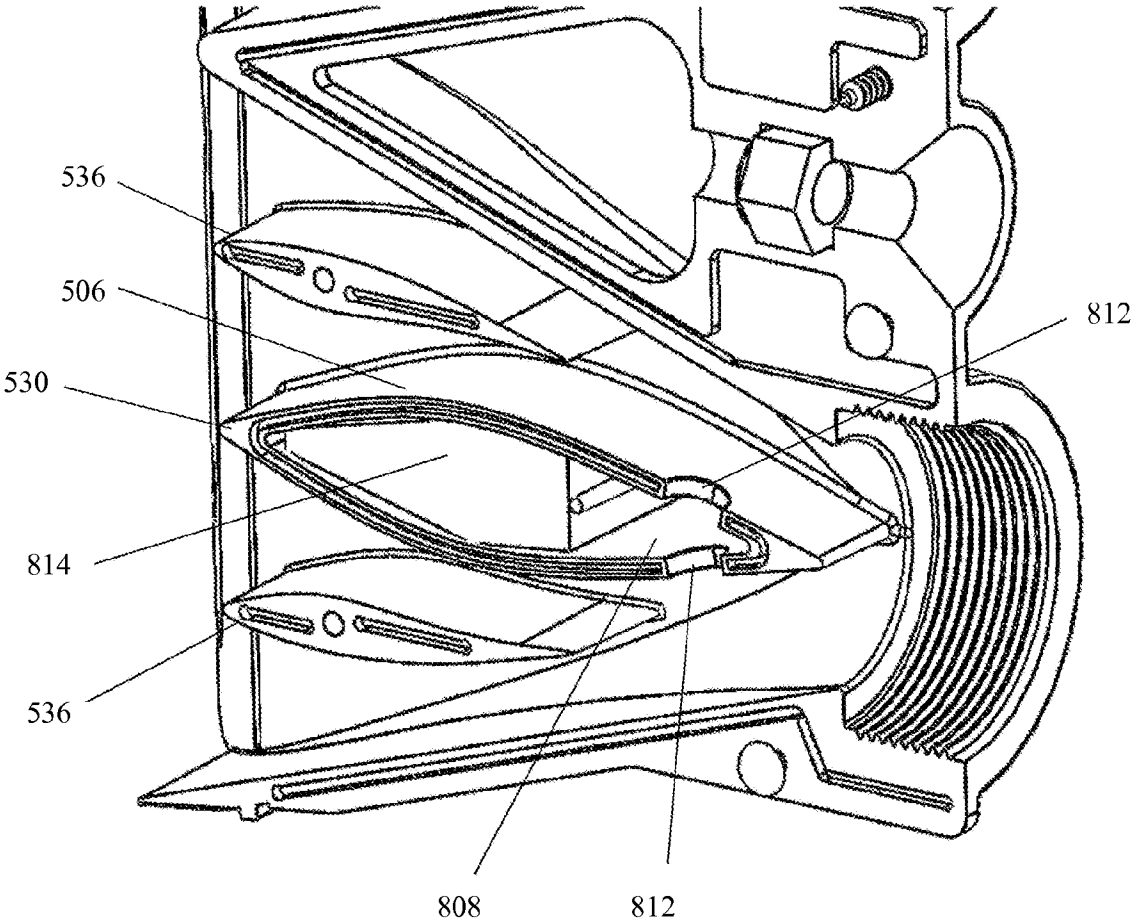
FIG. 10 shows an enlarged view of the tuned resonant cavity in the lower central vane of high frequency horn shown in FIG. 8, but from a top perspective view.

FIG. 10 shows an enlarged view of the tuned resonant cavity 804 in the lower central vane 530 of high frequency horn 502, but from a top perspective view. From this view, the positioning of the port 812 along the central vane 530 to create the opening or neck for the cavity 808 easily seen, along with the inclusion of the damping material 814, which reduces the volume of the space within the cavity 808 of the tuned resonant cavity 506.

Figure 11:
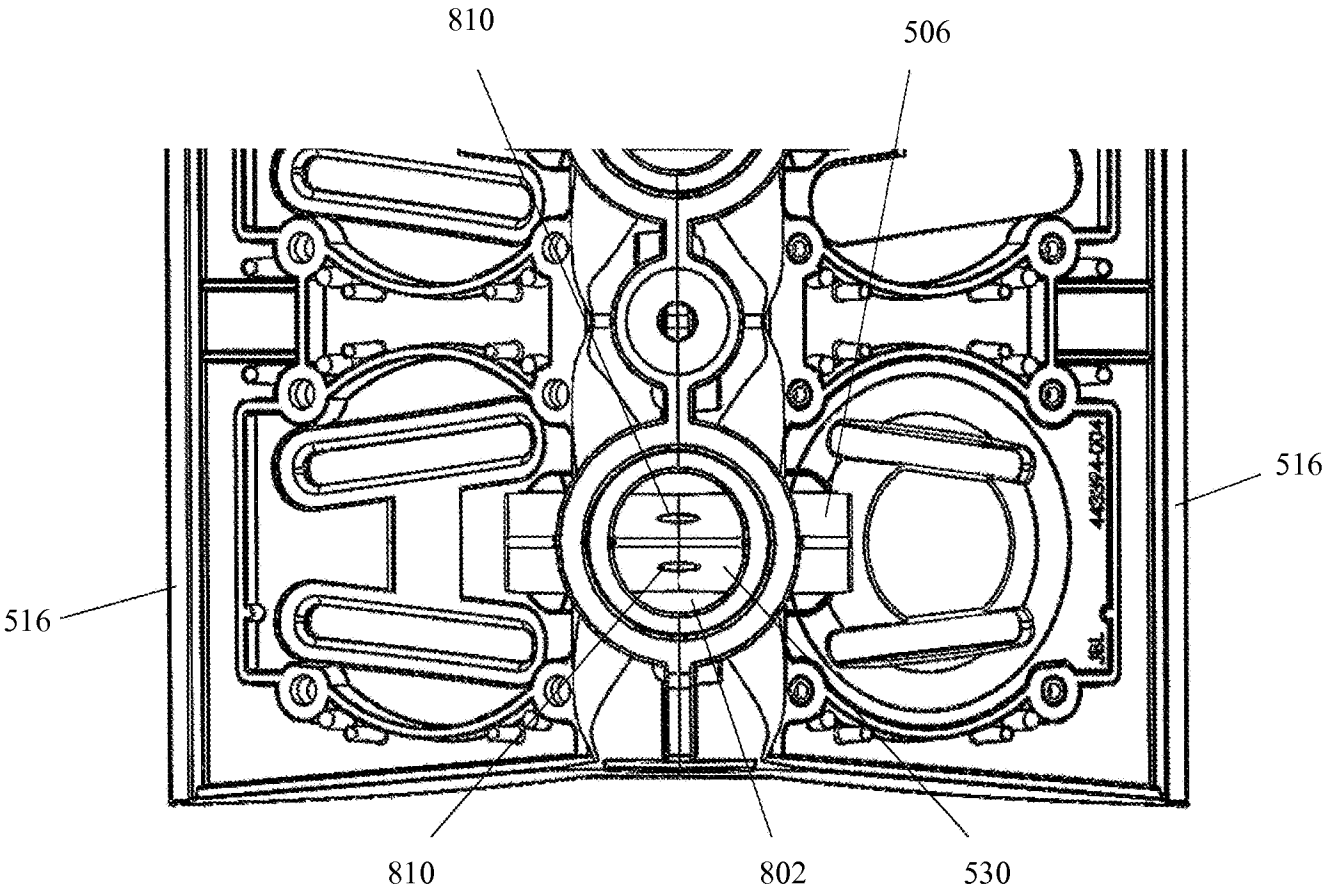
FIG. 11 shows a rear view of the line array horn in accordance with the present invention.

FIG. 11 shows a rear view of the line array horn in accordance with the present invention. FIG. 11 illustrates the port holes 810 positioned on the central vane 530, which open to a cavity within the central vane 530 for form the tuned resonant cavity 506.

Figure 12:
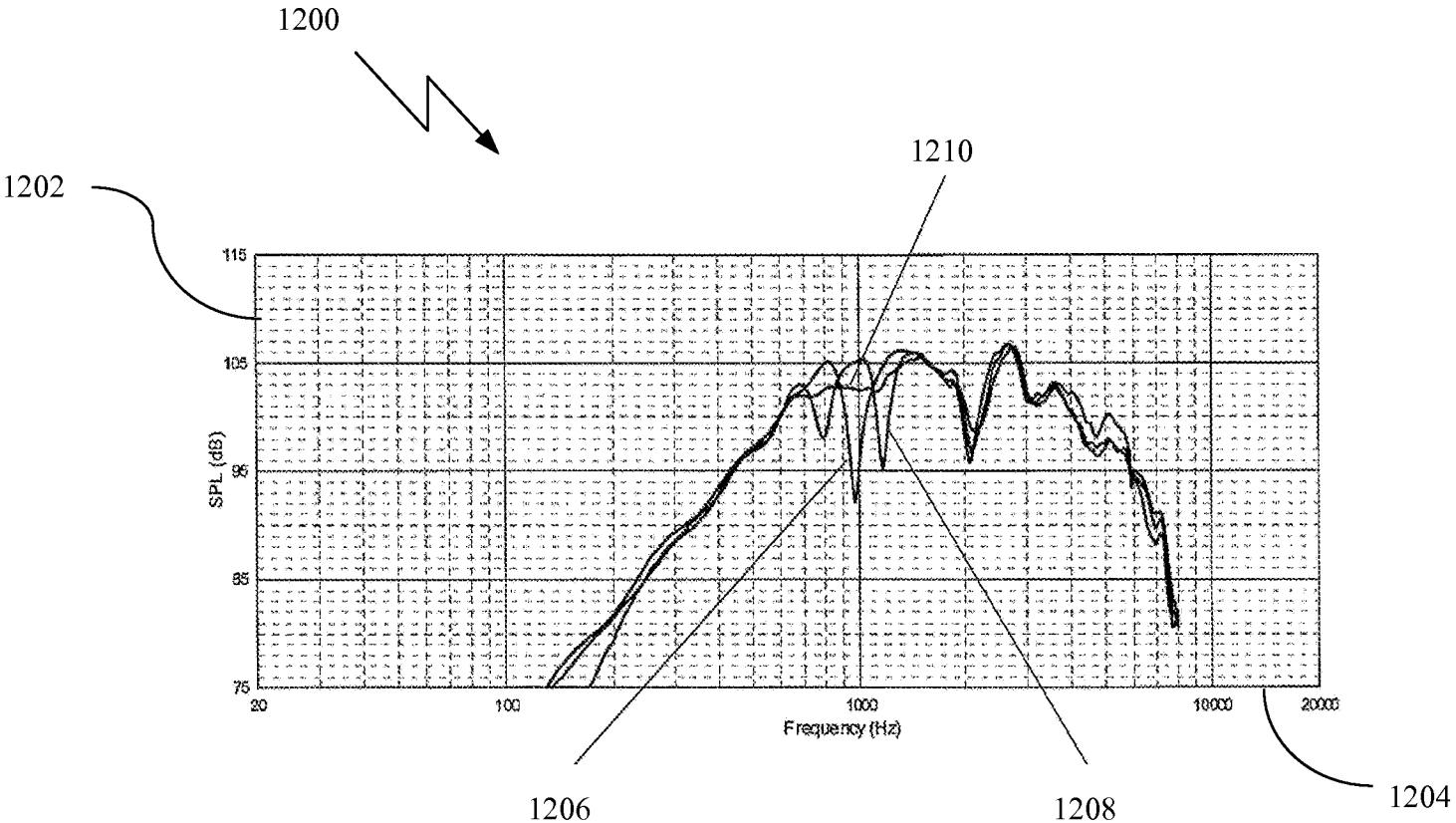
FIG. 12 shows plots of frequency response in terms of sound pressure level (dB) versus frequency (Hz).

FIG. 12 shows a frequency response curve 1200 that plots sound pressure level ("dB") along a vertical axis 1202 versus frequency in Hertz ("Hz") along a horizontal axis 1204. Curve 1206 illustrates the midrange frequency response of the high frequency horn 206 without correction (i.e., with a closed horn throat). As illustrated the sound pressure level "dips" at or around 1000 Hz. Curve 1208 illustrates the midrange frequency response of the high frequency horn 500 (or 502) using a tuned resonate cavity without dampening material. As illustrated the sound pressure level still "dips" at or around 1000 Hz, but not as great at the dip produced by the frequency response 1206 of the high frequency horn 206 without correction. Curve 1210 illustrates the midrange frequency response of the high frequency horn 500 (or 502) using a tuned resonant cavity with an optimized amount of acoustic dampening material. As illustrated, the dip in sound pressure level at or around 1000 Hz is eliminated. The response with the tuned chamber but without acoustically absorptive material is shown as 1208.

The above illustrated example, in connection with FIGS. 5-11, illustrates the tuned resonant cavity defined by a cavity positioned within the central vane of the horn chamber of the high frequency horn and further having two circular port openings on the central vane, which open into the cavity of the tuned resonant cavity. The tuned resonant cavity may, however, be positioned in other locations proximate to the high frequency transducer, such as on the side of the horn chamber with one or more port openings into the horn chamber. Further, the port holes or openings may be of different shapes, such as an oval shape, and should not be limited to the circular shape depicted in the illustrated example. Additionally, the example only illustrates the use of one tuned resonant cavity per high frequency horn; however, one or more tuned resonant cavities tuned to different frequency may also be utilized.

Figure 13:
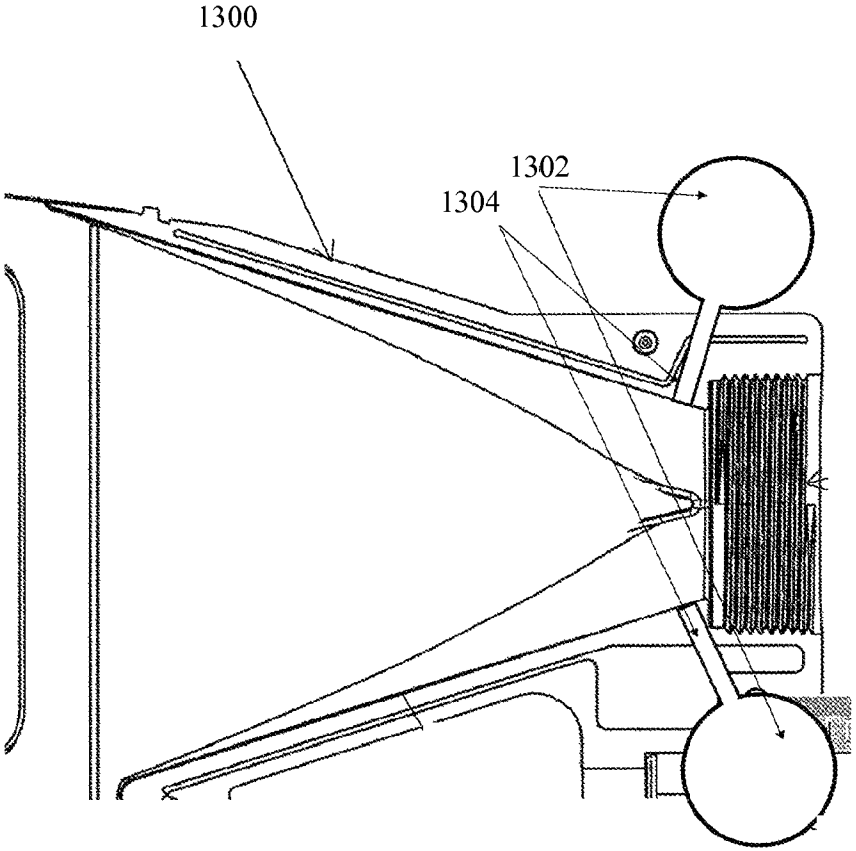
FIG. 13 shows a side view of another example of an implementation of a high frequency horn with two tuned resonant cavities on the side of the high frequency horn in accordance with the present invention.

Turning to FIG. 13, a high frequency horn 1300 is shown with two tuned resonant cavities 1302 on the side of the high frequency horn 1300. The tuned resonant cavities 1302 may be connected to the horn chamber via ports 1304.

Figures 14A, 14B:
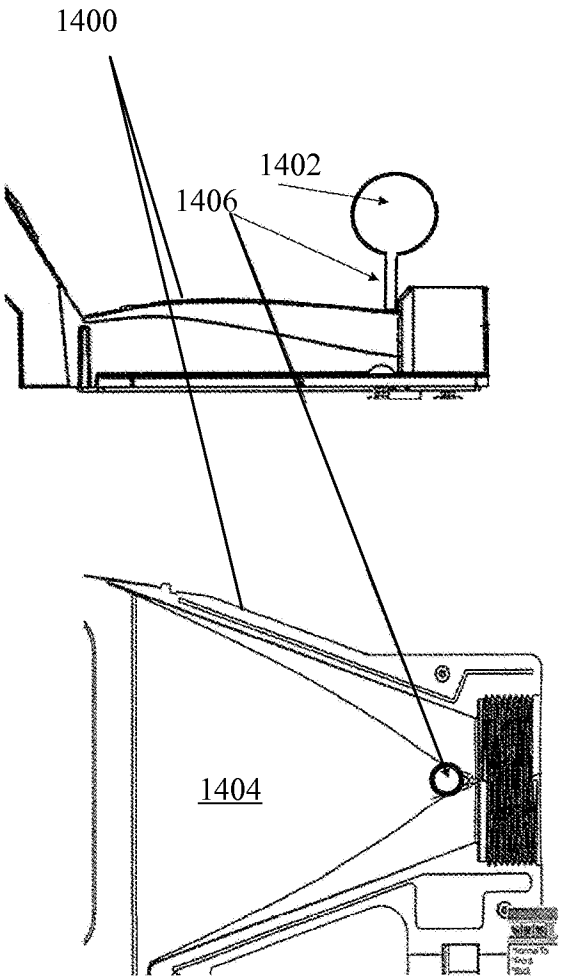
FIG. 14A shows a top view of yet another example of an implementation of a high frequency horn with a tuned resonant cavity on the side of the high frequency horn in accordance with the present invention.
FIG. 14B shows a side view of the high frequency horn shown in FIG. 14A.

In FIG. 14A, a top view of yet another example of an implementation of a high frequency horn 1400 with a tuned resonant cavity (not shown) on the side of the high frequency horn 1400 is shown. Similarly in FIG. 14B, a side view of the high frequency horn 1400 is shown with the tuned resonant cavity 1402. The tuned resonant cavity 1402 is connected to the horn chamber 1404 via port opening 1406.

Although the previous description only illustrates particular examples of various implementations, the invention is not limited to the foregoing illustrative examples. A person skilled in the art is aware that the invention as defined by the appended claims can be applied in various further implementations and modifications. In particular, a combination of the various features of the described implementations is possible, as far as these features are not in contradiction with each other. Accordingly, the foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A high frequency horn for use in a multiple frequency loudspeaker system having a midrange transducer and a high frequency transducer, the high frequency horn comprising:

a horn chamber, a horn mouth, and a horn throat, wherein the horn throat and the horn mouth are located on opposite sides of the horn chamber;

a sound vane disposed in the horn chamber;

a tuned resonant cavity located at least partially within the vane; and a port provided on the vane proximate to the horn throat, the port connecting the tuned resonant cavity to the horn chamber, wherein the horn throat is configured to be connected to the high frequency transducer, and wherein the tuned resonant cavity is tuned to reduce high frequency standing waves produced by the midrange transducer within the horn chamber.

2. The high frequency horn of claim 1, further including acoustically absorptive material within the tuned resonant cavity.

3. The high frequency horn of claim 1, wherein the horn mouth is connected to a horn flare, wherein the midrange transducer is mounted on the horn flare.

4. The high frequency horn of claim 3, further including acoustically absorptive material within the tuned resonant cavity.

5. The high frequency horn of claim 1, wherein the tuned resonant cavity includes two ports connecting the tuned resonant cavity to the horn chamber.

6. The high frequency horn of claim 1, wherein the tuned resonant cavity extends from within the vane to a resonant chamber positioned to the exterior of the horn chamber.

7. The high frequency horn of claim 1, wherein the horn mouth is connected to a horn flare and the wherein the midrange transducer is connected to the horn flare.

8. The high frequency horn of claim 7, wherein the horn flare is a sound integrator.

9. A high frequency horn comprising:

a pair of opposing side walls;

a pair of flared sides connecting the pair of opposing side walls and defining a horn chamber diverging from a horn throat at one end of the horn to a horn mouth at an opposite end;

a vane positioned within the horn chamber to disperse sound, the vane including a vane chamber defining at least a portion of a resonant cavity; and at least one port provided on the vane connecting the horn chamber to the resonant cavity.

10. The high frequency horn of claim 9, wherein the at least one port is positioned on the vane proximate to the horn throat.

11. The high frequency horn of claim 9, further including acoustically absorptive material within at least a portion of the resonant cavity.

12. The high frequency horn of claim 9, wherein the vane includes two ports connecting the horn chamber to the resonant cavity.

13. The high frequency horn of claim 9, wherein at least a portion of the resonant cavity defined by the vane chamber is positioned external to the horn chamber.

14. The high frequency horn of claim 13, wherein at least a portion of the resonant cavity extends beyond at least one of the pair of opposing side walls to a location external to the horn chamber.

15. The high frequency horn of claim 9, further comprising:

a high frequency transducer disposed at the horn throat; and a horn flare connected to the horn mouth and configured to mount a midrange transducer thereto, wherein the resonant cavity is tuned to reduce high frequency standing waves produced by the midrange transducer within the horn chamber.

16. The high frequency horn of claim 15, wherein the at least one port is positioned on the vane proximate to the horn throat.

* * * * *